United States Patent [19]

Ward

[11] 4,397,776

[45] Aug. 9, 1983

[54] LIQUID DETERGENT COMPOSITIONS CONTAINING ALPHA-AMINE OXIDE SURFACTANTS

[75] Inventor: James F. Ward, Fairfield, Ohio

[73] Assignee: The Procter & Gamble Company, Cincinnati, Ohio

[21] Appl. No.: 244,535

[22] Filed: Mar. 17, 1981

[51] Int. Cl.[3] ..... C11D 3/06; C11D 1/84

[52] U.S. Cl. ..... 252/527; 252/528; 252/546; 252/547

[58] Field of Search ..... 252/527, 528, 546, 547; 260/404; 562/442, 575

[56] References Cited

U.S. PATENT DOCUMENTS

| | | | |
|---|---|---|---|
| 117,904 | 2/1980 | Ferry | 252/528 |
| 2,159,967 | 5/1939 | Engelmann | 260/404 |
| 3,001,945 | 9/1961 | Drew et al. | 252/528 X |
| 3,281,368 | 10/1966 | Zimmerer et al. | 252/528 |
| 3,341,459 | 9/1967 | Davis | 252/547 X |
| 3,442,936 | 5/1969 | Budde | 264/409 |
| 3,647,868 | 3/1972 | Ernst | 252/546 X |
| 3,700,607 | 10/1972 | Sundby et al. | 252/527 |
| 4,247,424 | 1/1981 | Kuzel et al. | 252/528 |
| 4,284,532 | 8/1981 | Leikhim et al. | 252/528 |

OTHER PUBLICATIONS

Sweeley, et al., Rearrangement and Decarboxylation Reactions of N,N-Dimethylglycine Oxide, J. Am. Chem. Soc., 79:2620–2625, (1957).

Ferris, et al., Detoxication Mechanisms, II, The Iron--Catalyzed Dealkylation of Trimethylamine Oxide, J. Am. Chem. Soc., 89:5270–5275, (1967).

Craig, et al., Tertiary Amine Oxide Rearrangements, I. Mechanism, J. Am. Chem. Soc., 83:1871–1878, (1961).

*Primary Examiner*—P. E. Willis, Jr.

*Attorney, Agent, or Firm*—Donald E. Hasse; Steven J. Goldstein; Jack D. Schaeffer

[57] ABSTRACT

Liquid detergent compositions containing alpha-amine oxide surfactants and having a pH of from about 9.0 to about 13.0 are disclosed. The alpha-amine oxides have improved stability against metal-catalyzed decomposition in the present compositions. The compositions preferably contain heavy-metal chelating agents, and also other surfactants and detergent adjunct materials.

15 Claims, No Drawings

LIQUID DETERGENT COMPOSITIONS CONTAINING ALPHA-AMINE OXIDE SURFACTANTS

TECHNICAL FIELD

The present invention relates to liquid detergent compositions containing alpha-amine oxide surfactants, which are carboxylic acids or their salts having an amine oxide substituent at the alpha-carbon atom. The compositions herein provide outstanding cleaning, particularly of oily soils, in cool or cold water (i.e., 5°–20° C.) fabric laundering operations. The compositions are also useful for washing housewares such as dishes, glasses, pots and pans, etc. Importantly, the alpha-amine oxides herein exhibit improved stability against heavy-metal catalyzed decomposition because of the high pH of the present compositions (from about 9 to about 13). The compositions preferably contain heavy-metal chelating agents which enhance the stability of the alpha-amine oxides, and also other surfactants and detergent adjunct materials.

There has been considerable demand for detergent compositions capable of providing improved cleaning under cold water washing conditions. Besides the obvious economical benefits, there are many convenience and fabric care benefits to be obtained from cold water laundering. For example, dye transfer between fabrics is diminished thereby making it possible to launder mixed colored fabrics without sorting them. Laundering in cold water also results in less wrinkling of fabrics and avoids damage (e.g., shrinkage) to delicate fabrics which should not be washed in hot water.

BACKGROUND ART

U.S. Pat. No. 2,159,967, Engelmann, issued May 30, 1939, discloses carboxylic acids and their salts having an amine oxide substituent at the alpha-carbon atom. The compounds are generally described as being surfactants which can be used for or in admixture with soaps and soap substituents.

However, it has been found that the alpha-amine oxides have stability problems which can seriously affect their usefulness as detergent surfactants. It is believed that heavy-metal ions, such as copper, cobalt and particularly iron ions, form chelates with the alpha-amine oxides and catalyze their decomposition to relatively insoluble, non-surface active alpha-amino compounds. Trace amounts of such heavy metal ions (e.g., on the order of parts per million or less) normally present in detergent compositions can cause substantial decomposition of the alpha-amine oxides over a period of time.

The instability of the alpha-amine oxides is also partly due to the fact that structurally they are secondary amine oxides (i.e., the carbon atom next to the amine oxide substituent is attached to 2 other carbon atoms, instead of just one carbon atom as with primary amine oxides). As such, they decompose according to the Cope elimination reaction more readily than the primary amine oxides commonly used in the detergent industry (e.g., the alkyl dimethylamine oxides). However, since the alpha-beta unsaturated acids or salts formed by Cope elimination provide some detergency, the aforementioned metal-catalyzed decomposition represents the more serious stability problem.

SUMMARY OF THE INVENTION

The present invention encompasses liquid detergent compositions having a pH of from about 9.0 to about 13.0, comprising from about 0.005% to about 40% by weight of an amine oxide surfactant of the formula

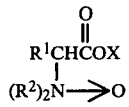

wherein $R^1$ is hydrogen or a $C_1$–$C_{20}$ hydrocarbyl group; each $R^2$ is a $C_1$–$C_{20}$ hydrocarbyl group or a $C_2$–$C_3$ alkylene oxide group containing from 1 to about 10 alkylene oxide units; and X is hydrogen or a water-soluble metal, ammonium or substituted ammonium cation; provided that the total number of carbon atoms in hydrocarbyl groups at the $R^1$ and $R^2$ substituents is from about 8 to about 36.

DETAILED DESCRIPTION OF THE INVENTION

The liquid detergent compositions herein containing the alpha-amine oxide surfactants provide outstanding cleaning, particularly of oily soils, in cool or cold water fabric laundering operations. The compositions can, of course, also be effectively used in warm or hot water according to the desires of the user. Light-duty liquid compositions herein containing the alpha-amine oxides as a primary surfactant, or as a suds booster in the manner described in U.S. Pat. No. 4,070,309, Jacobsen, issued Jan. 24, 1978, incorporated herein by reference, are particularly useful for cleaning housewares or hard surfaces. While the liquid detergents herein are typically aqueous systems, they can also be non-aqueous in nature, e.g., based on ethanol or isopropanol. The alkalinity of such systems is often also measured and referred to in terms of pH.

It has now been discovered that the stability of the alpha-amine oxides with respect to metal-catalyzed decomposition can be improved by maintaning the pH of liquid detergent compositions containing them anywhere from about 9.0 to about 13.0, preferably from about 9.5 to about 12.5, and more preferably from about 10.0 to about 12.0. While not intending to be limited by theory, it is believed that the high pH of the present compositions promotes the formation of metal oxides and decreases the availability of metal ions for chelating with the alpha-amine oxides. Additionally, the highly preferred chelating agents herein compete with the alpha-amine oxides for the metal ions and thus enhance stability by reducing the metal ion concentration.

The pH required in the present compositions can be obtained by the use of suitable alkaline materials, such as alkali metal or ammonium hydroxides, alkanolamines, (preferably monoethanolamine or triethanolamine), or detergent builder materials, which can also serve as the highly preferred chelating agents herein.

ALPHA-AMINE OXIDE SURFACTANT

In the general formula for the alpha-amine oxide surfactants herein, $R^1$ can be hydrogen or any $C_1$–$C_{20}$ hydrocarbyl group, such as a straight or branched chain alkyl, alkenyl, alkynyl, alkaryl (e.g., alkylphenyl or alkylbenzyl), or substituted hydrocarbyl (e.g., hydroxyalkyl) group. The nature of substituent $R^1$ can be varied by the selection of the parent carboxylic acid used in the reaction scheme for making the alpha-amine oxides, as disclosed hereinafter. (Although the alpha-substituted alkyaryl and unsaturated carboxylic acids are not readily available by the process disclosed in U.S. Pat. No. 4,148,811, Crawford, issued Apr. 10, 1979, they can be prepared using other known reactions.) Typical carboxylic acid starting materials include acetic acid, propionic acid, butyric acid, valeric acid, caproic acid, caprylic acid, capric acid, lauric acid, myristic acid, palmitic acid, stearic acid, oleic acid, eicosanoic acid, mixed coconut oil fatty acids, mixed palm oil fatty acids, mixed lard fatty acids, mixed soybean oil fatty acids, and mixed tallow fatty acids, which are preferred for cost considerations. $R^1$ is preferably a $C_8$–$C_{20}$ hydrocarbyl group, and most preferably a $C_{10}$–$C_{16}$ alkyl group.

Each $R^2$ substituent of the alpha-amine oxide surfactant can be any $C_1$–$C_{20}$ hydrocarbyl group or a $C_2$–$C_3$ alkylene, preferably ethylene, oxide group containing from 1 to about 10, preferably 1 to about 5, alkylene oxide units. Such a $C_2$–$C_3$ alkylene oxide group would commonly, and preferably, be terminated with a hydrogen atom, but also can be terminated with a methyl, ethyl or propyl group. Each $R^2$ is preferably a $C_1$–$C_4$ hydrocarbyl group, and more preferably a methyl, ethyl, 2-hydroxyethyl or 2-hydroxypropyl group.

Substituent X can be hydrogen or a water-soluble metal, ammonium or substituted ammonium cation. Suitable water-soluble metal cations include any of the alkali metal and alkaline earth metal cations. Useful substituted ammonium cations include, for example, the methyl-, dimethyl-, trimethyl-, diethanol- and triethanolammonium cations and quaternary ammonium cations such as tetramethylammonium and dimethyl piperidinium cations. Preferably X is a water-soluble alkali metal cation. Most preferably, X is sodium.

It will be appreciated that the above substituents should be selected such that the compounds herein exhibit sufficient surface activity and solubility for their intended use. Thus, the total number of carbon atoms in hydrocarbyl groups at the $R^1$ and $R^2$ substituents should be from about 8 to about 36, preferably from about 12 to about 26. Additionally, when the compounds herein have relatively long hydrocarbyl chains at the $R^1$ and one of the $R^2$ substituents, it is preferred that the other $R^2$ substituent be a $C_2$–$C_3$ alkylene (preferably ethylene) oxide group for optimum solubility, especially in cold water.

The economical practice of the present invention on an industrial scale ultimately depends on a ready source of alpha-halo carboxylic acids, from which the alpha-amine oxide surfactants herein are derived. Alpha-bromo carboxylic acids, which are available via the Hell-Volhard-Zelinsky reaction, are suitable starting materials. However, H-V-Z alpha-bromo acids are quite expensive. Fortunately, high quality, low cost alpha-chloro carboxylic acids suitable for use in preparing the alpha-amine oxides herein are available by the process disclosed in U.S. Pat. No. 4,148,811, Crawford, issued Apr. 10, 1979, incorporated herein by reference. Additionally, a preferred process for preparing 1,4-bis(-dicyanomethylene) cyclohexane, the precursor of the tetracyanoquinodimethane (TCNQ) used in the above process, is disclosed in U.S. Pat. No. 4,229,364, Crawford, issued Oct. 21, 1980, incorporated herein by reference.

The following is a typical synthesis of alpha-dimethylamine oxide tallow acid, using alpha-chloro tallow acid obtained by the process disclosed in U.S. Pat. No. 4,148,811, Crawford, as a representative starting material.

Preparation of Alpha-Dimethylamino Tallow Acid: A 2000 ml. 3-neck round bottom flask was fitted with a magnetic stirrer, dry ice reflux condenser, and thermometer. The flask was then charged with 750 ml. (4.2 moles) of 25% aqueous dimethylamine, 100 g. (0.33 mole) of alpha-chloro tallow acid, and 13.3 g. (0.33 mole) of sodium hydroxide. The resulting solution was stirred for 4 hours at 65° C. The dry ice condenser was removed and as much as possible of the excess dimethylamine was evaporated from the solution with a stream of nitrogen while stirring the solution at 50°–70° C. The evaporation of the dimethylamine was discontinued when the solution became too viscous to control the foaming. The reaction mixture was diluted with 2000 ml. of hot ethyl alcohol and allowed to cool slowly for crystallization. The crystallized product was collected by suction filtration, washed with alcohol and vacuum dried to afford 88 g. (86% yield) of alpha-dimethylamino tallow acid, having a melting point of 141°–142° C.

Preparation of Alpha-Dimethylamine Oxide Tallow Acid: A 1000 ml. 3-neck round bottom flask equipped with a thermometer and magnetic stirrer was charged with 100 g. (0.31 mole) of alpha-dimethylamino tallow acid dissolved in 310 ml. of 1 N sodium hydroxide and 150 ml. of ethyl alcohol. The solution was heated to 40°–45° C. while adding 54 g. (0.48 mole) of 30% hydrogen peroxide. The temperature rose to 55°–60° C. during addition of the hydrogen peroxide. The resulting solution was allowed to stir for 4 hours at 60° C. After cooling to 25° C., the solution was poured into a separatory funnel containing 150 ml. of glacial acetic acid and 200 ml. of distilled water, and extracted with two 500 ml. portions of chloroform. The organic layers were combined and stripped of all volatile material. The residual material was recrystallized from 700 ml. of acetone at 0° C. to give 90 g. (86% yield) of alpha-dimethylamine oxide tallow acid, having a melting point of 121.5°–123° C.

The liquid detergent compositions herein contain from about 0.005% to about 40%, preferably from about 1% to about 25%, and more preferably from about 3% to about 15%, by weight of the alpha-amine oxide surfactant.

OPTIONAL COMPONENTS

As a highly preferred component, the compositions herein contain from about 0.001% to about 35%, preferably from about 0.01% to about 25%, and more preferably from about 0.1% to about 15%, by weight of a heavy-metal chelating agent. The chelating agent sequesters heavy-metal ions and thus enhances the stability of the alpha-amine oxides by reducing the metal ion concentration. Useful chelating agents herein include all detergency builder materials suitable for use in liquid detergent compositions. While builders are generally characterized by an ability to sequester water hardness ions such as calcium and magnesium, they also possess varying degrees of ability to sequester the heavy-metal ions responsible for catalyzing the decomposition of the alpha-amine oxides. Furthermore, detergency builders also provide or assist in maintaining the alkaline pH required in the present compositions.

The preferred detergency builders herein are the water-soluble, alkali metal ammonium and substituted ammonium polycarboxylates, polyacetates, aminopolycarboxylates, polyphosphonates, aminopolyphosphonates, and polyphosphates. The alkali metal, especially sodium and potassium, salts of the above are preferred.

Examples of polycarboxylate and polyacetate builders useful herein are sodium and potassium ethylenediaminetetraacetates; the water-soluble salts of phytic acid (e.g., sodium and potassium phytates) disclosed in U.S. Pat. No. 2,739,942, Eckey, issued Mar. 27, 1956, incorporated herein by reference; and the polycarboxylate materials described in U.S. Pat. No. 3,364,103, incorporated herein by reference. Other preferred polycarboxylate builders herein are set forth in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other useful builders herein include the water-soluble salts, especially the sodium and potassium salts, of mellitic acid, citric acid, pyromellitic acid, benzene pentacarboxylic acid, oxydiacetic acid, carboxymethyloxysuccinic acid, cis-cyclohexanehexocarboxylic acid, cis-cyclopentanetetracarboxylic acid and oxydisuccinic acid.

Other suitable polycarboxylates for use herein are the polyacetal carboxylates described in U.S. Pat. No. 4,144,226, issued Mar. 13, 1979 to Crutchfield et al., and U.S. Pat. No. 4,146,495, issued Mar. 27, 1979 to Crutchfield et al., both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylic against rapid depolymerization in alkaline solution, converted to the corresponding salt, and added to a surfactant.

Highly preferred aminopolycarboxylates herein are the sodium and potassium salts of nitrilotriacetic acid, ethylenediaminetetraacetic acid, diethylenetriaminepentaacetic acid, and N(hydroxyethyl) ethylenediaminetriacetic acid.

Polyphosphonate builders useful herein are disclosed in U.S. Pat. No. 3,213,030, Diehl, issued Oct. 19, 1965, U.S. Pat. No. 3,433,021, Roy, issued Jan. 14, 1968, U.S. Pat. No. 3,292,121, Gedge, issued Jan. 9, 1969 and U.S. Pat. No. 2,599,807, Bersworth, issued June 10, 1952, all incorporated herein by reference. Preferred polyphosphonate builders are the sodium and potassium salts of ethylene diphosphonic acid, ethane 1-hydroxy-1,1-diphosphonic acid, and ethane-1,1,2-triphosphonic acid.

Preferred aminopolyphosphonate builders are the sodium and potassium salts of diethylenetriaminepentamethylenephosphonic acid, hexamethylenediaminetetramethylenephosphonic acid, diethylenediaminetetramethylenephosphonic acid, and nitrilotrimethylenephosphonic acid.

Polyphosphates useful herein include the water-soluble tripolyphosphates, pyrophosphates, and the polymeric metaphosphates having a degree of polymerization of from about 6 to 21. However, the tripolyphosphates and metaphosphates tend to hydrolyze to a mixture of orthophosphate and pyrophosphate with prolonged storage in aqueous solutions. Since the orthophosphates precipitate but do not sequester water-hardness ions, the pyrophosphates are the preferred polyphosphates for use in the present invention. Particularly preferred is potassium pyrophosphate since sodium pyrophosphate has a tendency to precipitate from concentrated solutions at low storage temperatures.

The water-soluble, alkali metal carbonate, bicarbonate, and silicate salts can also be used herein as the chelating agent. The alkali metal (preferably sodium) carbonates and silicates are particularly useful herein for providing the alkaline pH required in the present compositions. The silicates also provide corrosion inhibition protection to the metal parts of washing machines. Suitable silicate solids have a molar ratio of $SiO_2$ to alkali metal oxide in the range from about 1:2 to about 4:1, preferably from about 1.6:1 to about 2.4:1.

The most preferred chelating agents herein are the sodium and potassium salts of diethylenetriaminepentaacetic acid and N(hydroxyethyl) ethylenediaminetriacetic acid. However, because these chelating agents are relatively expensive, it is preferred that they be used at very low levels in the present compositions, e.g., from about 0.001% to about 3%, more preferably from about 0.01% to about 2%, and most preferably from about 0.1% to about 1%, by weight of the detergent composition.

Other less expensive builders which are highly preferred for use herein are sodium and potassium nitrilotriacetate, sodium and potassium citrate and potassium pyrophosphate. Such builders preferably represent from about 3% to about 20%, more preferably from about 5% to about 15%, by weight of the detergent composition. The formulation of stable liquid detergent compositions containing high levels of such builders is described in U.S. Pat. No. 3,351,557, Almstead, et al., issued Nov. 7, 1967 and in U.S. Pat. No. 3,192,166, Smith, issued June 29, 1965, both incorporated herein by reference.

Detergent compositions of the present invention also preferably contain one or more organic cosurfactants selected from the group consisting of anionic, cationic, nonionic, ampholytic and zwitterionic surfactants, and mixtures thereof. These surfactants are described in U.S. Pat. No. 3,919,678, Laughlin et al., issued Dec. 30, 1975, incorporated herein by reference. Useful cationic surfactants also include those described in U.S. Pat. No. 4,222,905, Cockrell, issued Sept. 16, 1980, incorporated herein by reference. The cosurfactant represents from about 0.005% to about 40%, preferably from about 2% to about 30%, more preferably from about 5% to about 20%, by weight of the detergent composition.

Preferred cosurfactants herein are the nonionic surfactants described in U.S. Pat. No. 3,929,678, cited above, from column 13, line 14 to column 16, line 6. Particularly preferred nonionic surfactants for use herein include the ethoxylated alcohols or ethoxylated alkyl phenols of the formula $R(OCH_2CH_2)_nOH$, wherein R is a $C_8$–$C_{18}$ hydrocarbyl group or a $C_8$–$C_{15}$ alkyl phenyl group and n is from about 3 to about 12. Of this group, the ethoxylated alcohols are preferred because of their superior biodegradability. Particularly preferred are the ethoxylated alcohols in which R is a $C_9$–$C_{15}$ alkyl group and n is from about 4 to about 8. A preferred weight ratio of the above nonionic surfactants to the alpha-amine oxide surfactants herein is from about 1:4 to about 4:1, more preferably from about 1:2 to about 2:1.

Useful anionic cosurfactants specifically include those described in U.S. Pat. No. 3,929,678 from column 23, line 57 to column 35, line 20, and those described in U.S. Pat. No. 4,199,483, Jones, issued Apr. 22, 1980, from column 5, line 3 to column 6, line 26, incorporated herein by reference.

Specific preferred anionics for use herein include: the linear $C_9$–$C_{15}$ alkylbenzene sulfonates (LAS); the branched $C_9$–$C_{15}$ alkylbenzene sulfonates (ABS); the tallow alkyl sulfates, the coconut alkyl glyceryl ether sulfonates; the sulfated condensation products of mixed $C_{10}$–$C_{18}$ fatty alcohols with from about 1 to about 14 moles of ethylene oxide; and the mixtures of higher fatty acid soaps containing from 10 to 18 carbon atoms.

Other ingredients commonly used in liquid detergent compositions can be included in the compositions of the present invention. These include color speckles, bleaching agents and bleach activators, suds boosters or suds suppressors, anti-tarnish and anti-corrosion agents, soil suspending agents, soil release agents, dyes, fillers, optical brighteners, germicides, pH adjusting agents, non-builder alkalinity sources, hydrotropes, enzymes, enzyme-stabilizing agents and perfumes.

The following non-limiting examples illustrate the detergent compositions of the present invention.

All percentages, parts, and ratios used herein are by weight unless otherwise specified.

EXAMPLE I

The stability of sodium alpha-dimethylamine oxide tallowate in aqueous solution was evaluated as a function of storage temperature, pH of the solution, and iron concentration. The stability was determined by measuring the percent of the two primary iron-catalyzed decomposition products, sodium alpha-monomethylamino tallowate (MMAT) and sodium alpha-dimethylamino tallowate (DMAT). All solutions were first passed through a Chelex-100 ion exchange resin to reduce the iron concentration to a uniformly low level. Iron (as ferrous sulfate) was then added back to some of the solutions as indicated. After 7 days, the results were as follows.

TABLE I

| Temperature (°C.) | pH | Added Fe (ppm) | MMAT (%) | DMAT (%) |
|---|---|---|---|---|
| 21 | 9.5 | 0 | — | — |
| 21 | 10.5 | 0 | 0.1 | * |
| 21 | 11.5 | 0 | * | * |
| 21 | 9.5 | 5.0 | 1.0 | * |
| 21 | 10.5 | 2.5 | 0.5 | * |
| 21 | 11.5 | 20 | — | — |
| 49 | 9.5 | 0 | 13 | 3 |
| 49 | 10.5 | 0 | 7 | 2 |
| 49 | 11.5 | 0 | 8 | 6 |
| 49 | 9.5 | 5.0 | 23 | 6 |
| 49 | 10.5 | 2.5 | 15 | 4 |
| 49 | 11.5 | 20 | 11 | 5 |

* = none detected

The stability (after 35 days at a temperature of 49° C.) of the sodium alpha-dimethylamine oxide tallowate in an aqueous solution (pH of 9.5) was evaluated as a function of added sodium diethylenetriaminepentaacetate (DPTA), based on the mole percent of alpha-amine oxide. The results were as follows.

TABLE II

| DTPA (%) | MMAT (%) | DMAT (%) |
|---|---|---|
| 0 | 28 | 8 |
| 0.12 | 15 | 4 |
| 1.2 | 4 | 1 |
| 12 | 0.5 | 0.5 |

The above data demonstrate that the stability of the alpha-amine oxides is improved at higher pH's and by the addition of chelating agents. The data also support the hypothesis that iron ions catalyze the decomposition of the alpha-amine oxides.

EXAMPLE II

The following are heavy-duty liquid detergent compositions according to the present invention.

| Component | A | B | C | D |
|---|---|---|---|---|
| $C_{12-13}$ $E_{6.5}$ nonionic surfactant* | 11.0 | 13.1 | 11.0 | |
| Sodium alpha-dimethylamine oxide cocoate | 6.6 | 8.1 | | |
| Sodium alpha-dimethylamine oxide tallowate | | | 6.6 | 10.0 |
| Sodium citrate | 9.0 | | | |
| Sodium nitrilotriacetate | | | 12.0 | |
| Potassium pyrophosphate | | 10.0 | | |
| Potassium toluene sulfonate | 6.6 | | 9.0 | |
| Phosphate Ester (Witco PS-413) | | 12.0 | | |
| Monoethanolamine | 3.6 | 3.6 | 4.0 | 4.0 |
| Coconut fatty acid | 0.5 | | | |
| Sodium diethylenetriaminepentaacetate | 0.5 | | | 2.0 |
| Sodium N(hydroxyethyl)ethylenediaminetriacetate | | 0.5 | | |
| Water and miscellaneous | Balance to 100 | | | |

*Condensation product of a $C_{12-13}$ linear primary alcohol with 6.5 moles (avg.) of ethylene oxide.

The above compositions are prepared simply by mixing the components and adjusting the pH to about 11.3 with sodium hydroxide. When used at a level of 1400 parts per million, they provide outstanding cleaning of soiled fabrics under cold water usage conditions.

EXAMPLE III

The following are light-duty liquid detergent compositions according to the present invention.

| Component | A | B |
|---|---|---|
| Sodium alpha-dimethylamine oxide cocoate | 4.0 | |
| Sodium alpha-dimethylamine oxide tallowate | | 4.0 |
| Sodium coconutalkyl polyethoxylate (3 avg.) sulfate | 22.0 | 24.0 |
| Ethanol | 9.0 | 7.0 |
| Sodium diethylenetriaminepentaacetate | 1.0 | 2.0 |
| Water and miscellaneous | Balance to 100 | |

The above compositions are prepared simply by mixing the components and adjusting the pH to about 10.0 with sodium hydroxide. The compositions are especially useful for cleaning dishes and other housewares.

Other compositions within the scope of the present invention are obtained by replacing the alpha-amine oxides in the compositions of Examples II and III with the corresponding compounds derived from capric acid, lauric acid, myristic acid, palmitic acid, stearic acid, oleic acid, mixed palm oil fatty acids, mixed lard fatty acids, and mixed soybean oil fatty acids.

Other compositions are obtained by replacing the above alpha-amine oxides with sodium alphacoconutalkylmethylamine oxide cocoate, sodium alpha-dicoconutalkylamine oxide acetate, sodium alpha-tallowalkyltriethoxylateamine oxide acetate, and sodium alpha-stearylethanolamine oxide propionate.

What is claimed is:

1. A liquid detergent composition having a pH of from about 9.0 to about 13.0, comprising:

(a) from about 0.005% to about 40% by weight of an amine oxide surfactant of the formula

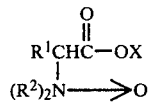

wherein $R^1$ is hydrogen or a $C_1$–$C_{20}$ hydrocarbyl group; each $R^2$ is a $C_1$–$C_{20}$ hydrocarbyl group or a $C_2$–$C_3$ alkylene oxide group containing from 1 to about 10 alkylene oxide units; and X is hydrogen or a water-soluble metal, ammonium or substituted ammonium cation; provided that the total number of carbon atoms in hydrocarbyl groups at the $R^1$ and $R^2$ substituents is from about 8 to about 36; and (b) from about 0.001% to about 35% by weight of a heavy-metal chelating agent selected from the group consisting of alkali-metal, ammonium and substituted ammonium polycarboxylates, aminopolycarboxylates, polyphosphonates, aminopolyphosphonates, and polyphosphates, and mixtures thereof.

2. A composition according to claim 1 comprising from about 0.01% to about 25% by weight of the chelating agent.

3. A composition according to claim 2 comprising from about 0.1% to about 15% by weight of the chelating agent.

4. A composition according to claim 1 wherein the chelating agent is the sodium or potassium salt of nitrilotriacetic acid, ethylenediaminetetraacetic acid, diethylenetriaminepentaacetic acid or N(hydroxyethyl) ethylenediaminetriacetic acid, or mixtures thereof.

5. A composition according to claim 4, wherein the chelating agent is the sodium or potassium salt of diethylenetriaminepentaacetic acid or N(hydroxyethyl) ethylenediametriacetic acid, or mixtures thereof.

6. A composition according to claim 1 comprising from about 0.1% to about 1% by weight of the chelating agent.

7. A composition according to claim 1 comprising from about 3% to about 20% by weight of sodium or potassium nitrilotriacetate, sodium or potassium citrate, or potassium pyrophosphate, or mixtures thereof.

8. A composition according to claim 7 further comprising from about 0.1% to about 1% by weight of the sodium or potassium salt of diethylenetriaminepentaacetic acid or N(hydroxyethyl) ethylenediametriacetic acid, or mixtures thereof.

9. A composition according to claims 1 or 5 having a pH of from about 10.0 to about 12.0.

10. A composition according to claim 9 wherein $R^1$ is a $C_{10}$–$C_{16}$ alkyl group, each $R^2$ is a methyl, ethyl, 2-hydroxyethyl or 2-hydroxypropyl group, and X is sodium.

11. A composition according to claim 1 further comprising from about 0.005% to about 40% by weight of an anionic, cationic, nonionic, ampholytic, or zwitterionic cosurfactant, or mixtures thereof.

12. A composition according to claim 11 comprising from about 5% to about 20% by weight of the cosurfactant.

13. A composition according to claim 11 wherein the cosurfactant is an ethoxylated alcohol or alkyl phenol of the formula $R(OCH_2CH_2)_nOH$, wherein R is a $C_8$–$C_{18}$ hydrocarbyl group or a $C_8$–$C_{15}$ alkyl phenol group and n is from about 3 to about 12.

14. A composition according to claim 13 wherein R is a $C_9$–$C_{15}$ alkyl group and n is from about 4 to about 8.

15. A composition according to claim 14 wherein $R^1$ is a $C_{10}$–$C_{16}$ alkyl group, each $R^2$ is a methyl, ethyl, 2-hydroxyethyl or 2-hydroxypropyl group, and X is sodium.

* * * * *